US005725388A

United States Patent [19]

Huang

[11] Patent Number: 5,725,388

[45] Date of Patent: Mar. 10, 1998

[54] ROTATABLE SPRING ACTUATED THREE PART INSULATED SAFETY ELECTRICAL SOCKET

[75] Inventor: Brian Huang, Kaohsiung, Taiwan

[73] Assignee: Auto Search Industrial Instrument Co., Ltd., Kaohsiung, Taiwan

[21] Appl. No.: 596,484

[22] Filed: Feb. 5, 1996

[51] Int. Cl.[6] ..... H01R 29/00

[52] U.S. Cl. ..... 439/188; 200/51.09

[58] Field of Search ..... 200/51.1, 51.09; 439/188, 332

[56] References Cited

U.S. PATENT DOCUMENTS

| | | | |
|---|---|---|---|
| 3,383,481 | 5/1968 | Bailey et al. | 200/51.1 |
| 4,113,336 | 9/1978 | Hon Man | 439/332 |

*Primary Examiner*—Neil Abrams
*Assistant Examiner*—Barry M. L. Standig
*Attorney, Agent, or Firm*—Finnegan, Henderson, Farabow, Garrett & Dunner

[57] ABSTRACT

A safety electrical socket includes front and rear insulative bodies which are connected to one another and a receptacle body. The front insulative body has a through bore which has a first section of a smaller diameter and a second section. The rear insulative body has a cavity which is concentric with the second section of the through bore. The cavity has two opposed, narrower side walls which have two contacts connected to an electrical power source. The receptacle body has front and rear portions and an annular flange formed between the front and rear portions. The receptacle body is movable axially in the through bore to enable the rear portion to extend into or retract from the cavity. A pair of elongated conductors are pivoted respectively to two opposite wider sides of the rear portion. When a pair of contact blades are inserted into the socket openings in the front portion and the axial grooves in the wider sides and when the rear portion which extends into the cavity is rotated by a predetermined angle, the conductors can be depressed by the contacts of the rear insulative body in order to engage the contact blades. The conductors disengage from the contact blades and the contacts by means of biasing members when the receptacle body is further rotated by the predetermined angle in a reverse direction.

4 Claims, 5 Drawing Sheets

ROTATABLE SPRING ACTUATED THREE PART INSULATED SAFETY ELECTRICAL SOCKET

BACKGROUND OF THE INVENTION

1. Field of the Invention

This invention relates to an electrical socket, more particularly to a safety electrical socket.

2. Description of the Related Art

As the number of electrical appliances acquired by a household grows, the need for numerous electrical sockets which can be conveniently accessed becomes an important factor in housing design.

Referring to FIGS. 1 and 2, a conventional electrical socket 1 is shown to comprise a socket housing 13 which is to be mounted in a wall. A receptacle body 12 is secured to the socket housing 13 and is provided with socket openings 121. The electrical socket 1 further has a socket plate 11 which is used to cover the socket housing 13 and which is formed with a through hole 111 to access the socket 111 of the receptacle body 12.

One of the disadvantages of the conventional electrical socket 1 is that it is not provided with a cover structure for covering the socket openings 121 when the electrical socket 1 is not in use. Since the electrical socket 1 is usually installed within reach of children, and since most children would frequently notice their elders plugging and unplugging electrical appliances from the electrical socket 1, they would eventually become curious and might decide to play with them, not knowing the dangers of doing so. Accidental fire or electrical shock may occur if a child unknowingly inserts a conductive object into the electrical socket 1.

SUMMARY OF THE INVENTION

It is a main object of the present invention to provide a safety electrical socket which can prevent occurrence of accidental fire of electrical shock when a child inserts a conductive object into the electrical socket.

According to the present invention, the safety electrical socket comprises:

a rear insulative body having a generally flat face, a cavity which is formed in the flat face and which has two opposed, narrower side walls, a pair of contacts fixed respectively to the narrower side walls, and two wires connected respectively to the contacts for supplying electrical power to the contacts;

a front insulative body having opposed first and second faces, a through bore extending from the first face to the second face, the second face being generally flat, the through bore being formed of a first section of a smaller diameter which is adjacent to the first face, a second section which is adjacent to the second face, and a first shoulder which is formed between the first and second sections, the front insulative body being detachably connected to the rear insulative body in such a manner that the second face abuts the flat face of the rear insulative body and the through bore of the front insulative body is concentric with the cavity of the rear insulative body, the cavity having a size which is smaller than that of the second section of the through bore, thereby defining a second shoulder between the second face of the front insulative body and the flat face of the rear insulative body;

a receptacle body having a cylindrical front portion with first and second ends, an annular flange extending radially from the second end of the front portion, and a rear portion extending coaxially from the second end of the front portion, the rear portion having two opposite wider sides, the front portion being inserted coaxially and slidably into the first section of the through bore so that the receptacle body can be moved between a first position, wherein the annular flange abuts the first shoulder and the first end of the front portion of the receptacle body extends out of the first face of the front insulative body, and a second position, where the annular flange abuts the second shoulder and the rear portion of the receptacle body extends into the cavity of the rear insulative body, the front portion having a pair of socket openings which extends from the first end to the second end thereof, each of the wider sides of the rear portion having an axially extending groove which is connected to a respective one of the socket openings, a conductor which is disposed over the axially extending groove and which has a first end connected pivotally to one side of the axially extending groove and a second end located on the other side of the axially extending groove, and a biasing member which is mounted between the other side of the axially extending groove and the second end of the conductor in order to urge the conductor to move away from the axially extending groove, so that when a pair of contact blades of an electrical plug are inserted into the socket openings and extend into the axially extending grooves and when the receptacle body in the second position is rotated by a predetermined angle, the conductors can be depressed by the contacts of the rear insulative body against the biasing force of the biasing member to engage the contact blades of the electrical plug in the axially extending grooves, and so that when the receptacle body is further rotated by the predetermined angle in a reverse direction, the conductors can be moved away from the axially extending grooves and be disengaged from the contact blades and the contacts

BRIEF DESCRIPTION OF THE DRAWINGS

Other features and advantages of this invention will become apparent in the following detailed description of the preferred embodiment of this invention with reference to the accompanying drawings, of which.

DETAILED DESCRIPTION OF THE PREFERRED EMBODIMENT

Figure 1:
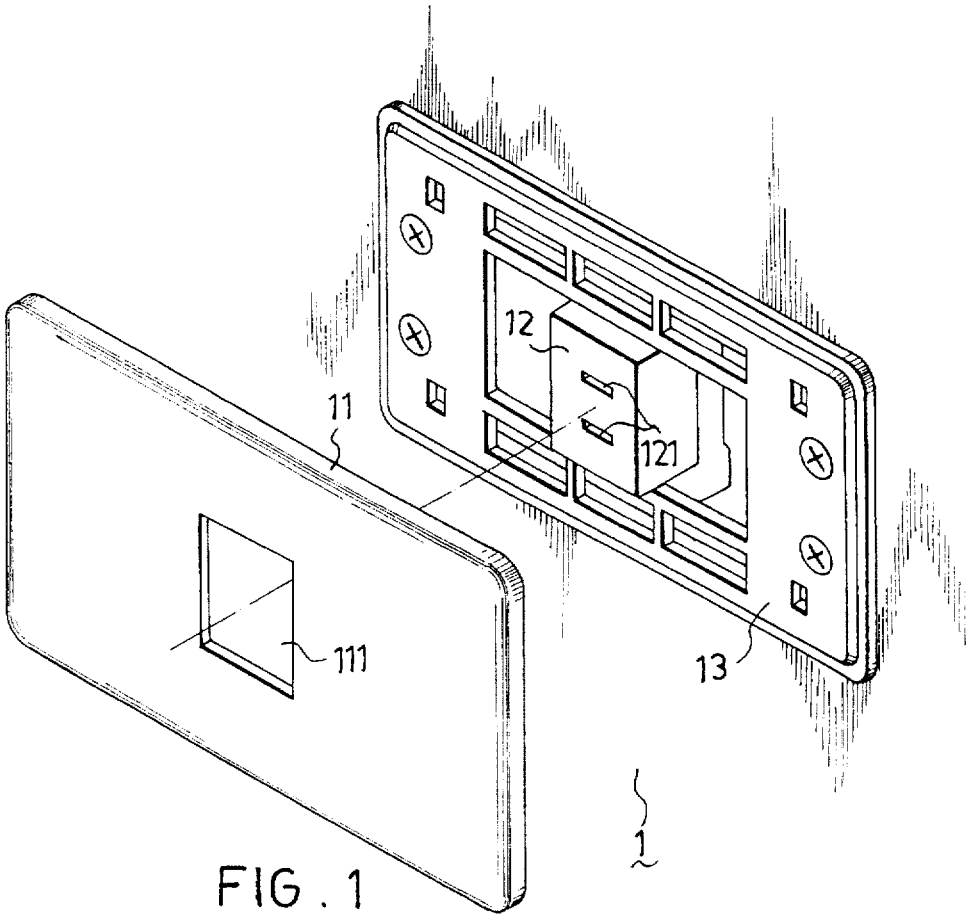
FIG. 1 (PRIOR ART)
FIG. 1 is a partially exploded view of a conventional electrical socket.
Figure 2:
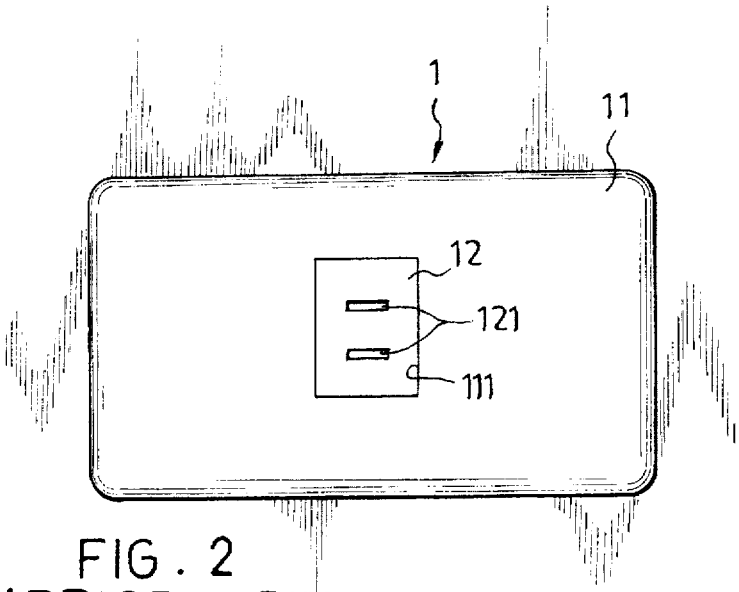
FIG. 2 (PRIOR ART)
FIG. 2 is a front view of the conventional electrical socket shown in FIG. 1.
Figure 3:
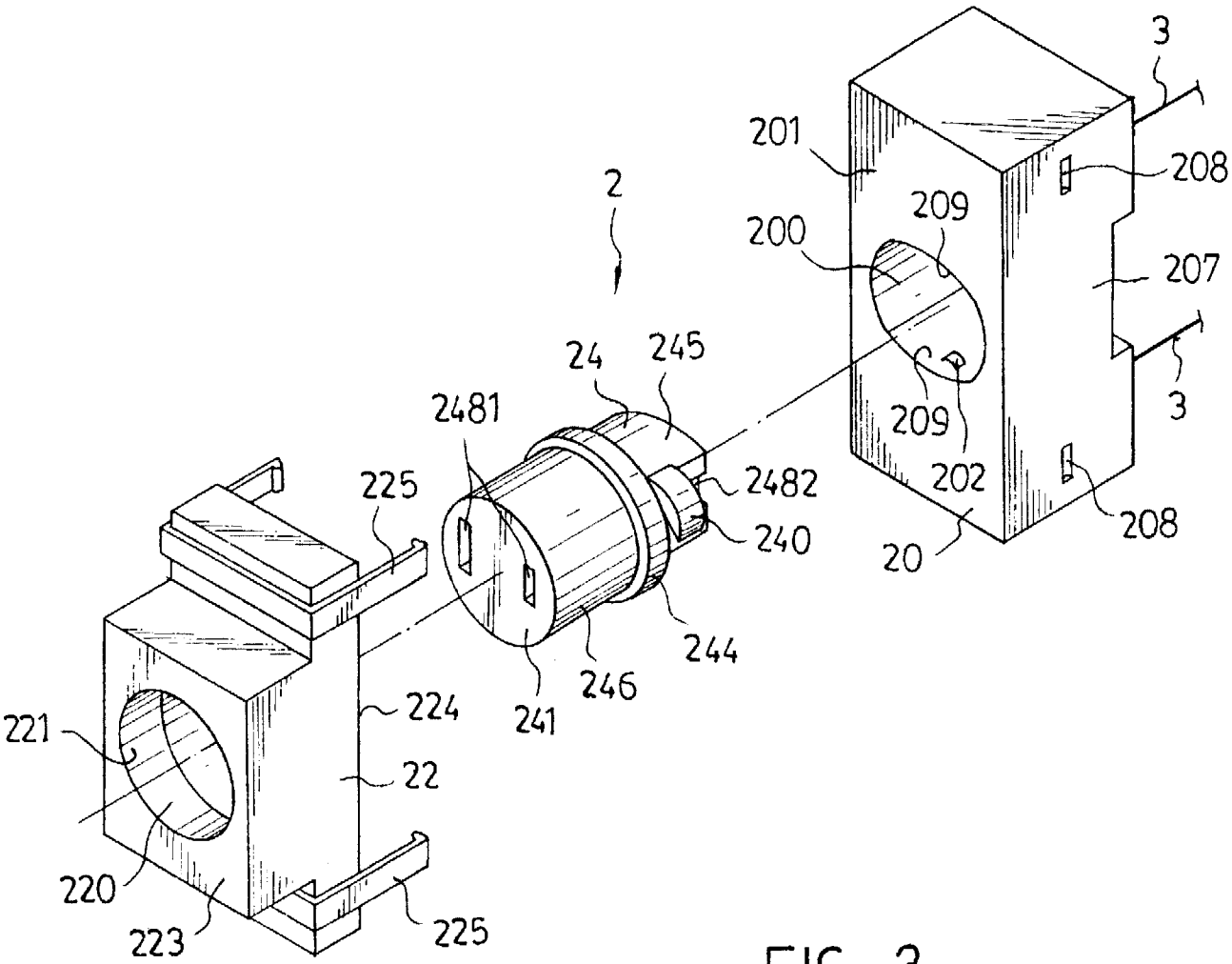
FIG. 3 is an exploded perspective view of a preferred embodiment of an electrical socket according to the present invention.
Figure 4:
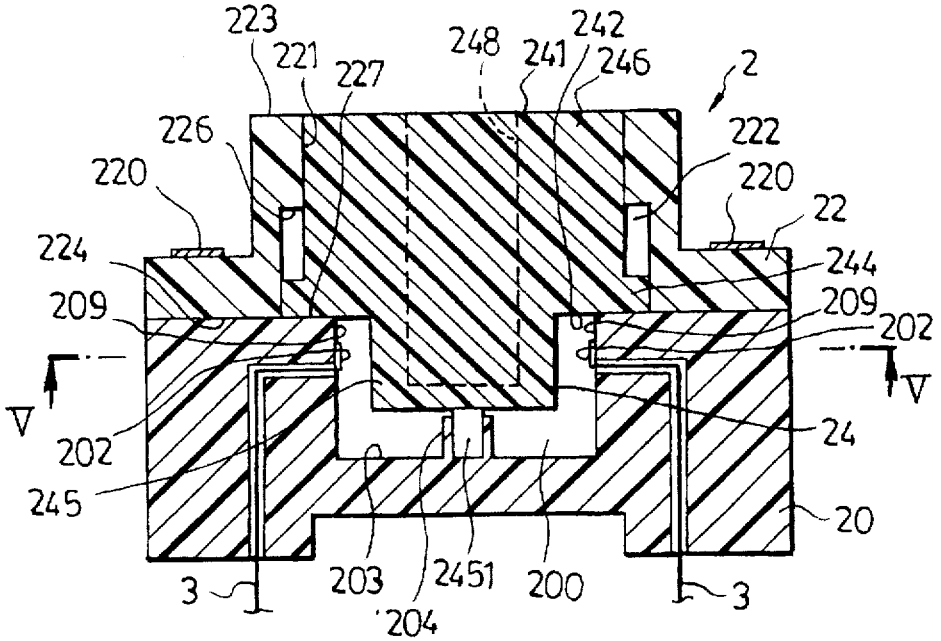
FIG. 4 is a sectional view of the preferred embodiment of the electrical socket according to the present invention.

Referring to FIGS. 3 and 4, a preferred embodiment of a safety electrical socket 2 is shown to comprise a rear insulative body 20, a front insulative body 22, and a receptacle body 24.

The rear insulative body 20 has a cavity 200 which is formed in the center of a flat face 201 of the rear insulative body 20. The cavity 200 has a pair of contacts 202 which contacts are fixed respectively to two opposed, narrower side walls 209 thereof, and two wires 3 connected respectively to the contacts 202 for supplying electrical power to the contacts 202. The two external opposite side faces 207 (only one side face is shown) of the rear insulative body 20 are formed with two pairs of retaining holes 208.

The front insulative body 22 has opposed first 223 and second 224 faces, a through bore 220 extends from the first face 223 to the second face 224. The first and second faces 223, 224 are generally flat. The through bore 220 is formed of a first section 221 of a smaller diameter which is adjacent to the first face 223, a second section 222 (See FIG. 4) which is adjacent to the second face 224, and a first shoulder 226 which is formed between the first and second sections 221, 222. The front insulative body 22 has two pairs of retaining arms 225 which engage the pairs of retaining holes 208 so as to detachably connect to the rear insulative body 20. The second face 224 abuts the flat face 201 of the rear insulative body 20 and the through bore 220 of the front insulative body 22 is concentric with the cavity 200 of the rear insulative body 20. The size of the cavity 200 is smaller than that of the second section 222 of the through bore 220, thereby defining a second shoulder 227 between the second face 224 of the front insulative body 22 and the flat face 201 of the rear insulative body 20.

Figure 5:
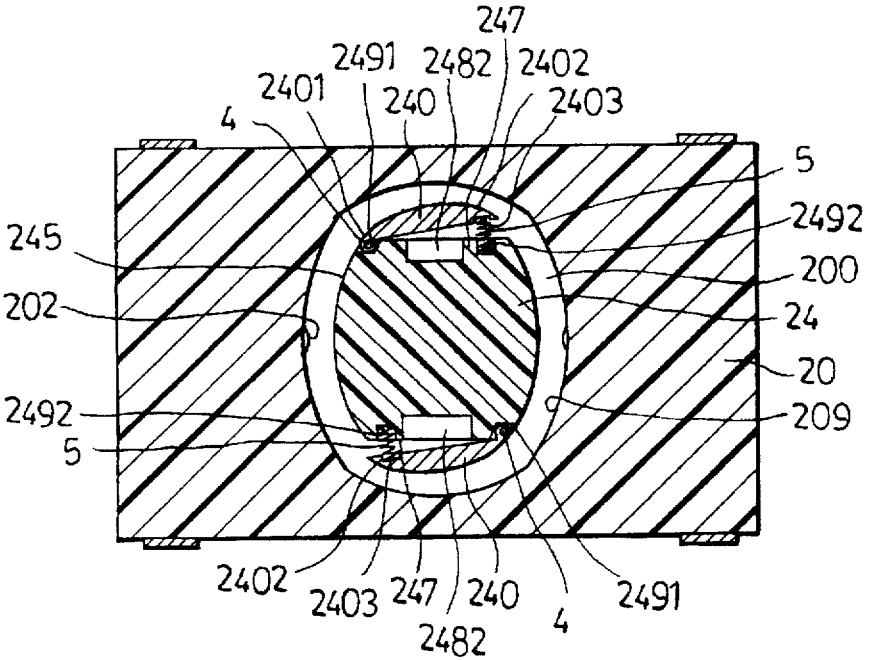
FIG. 5 is a cross sectional view taken along the line V—V in FIG. 4.
Figure 6:
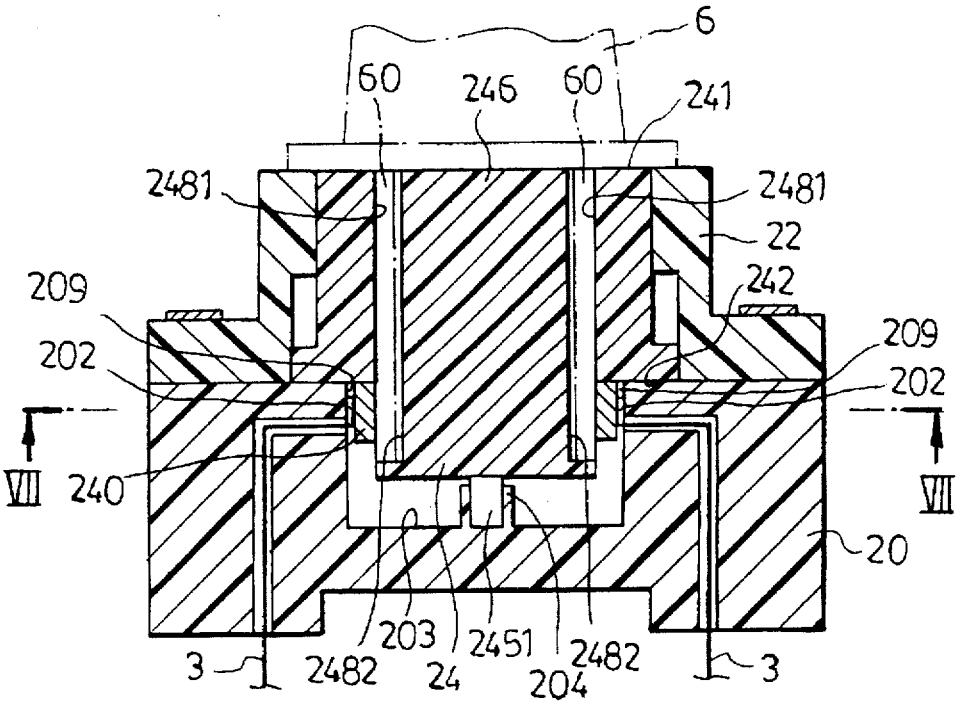
FIG. 6 is a sectional view illustrating the preferred embodiment when in use, in which the receptacle body is in a second position.
Figure 8:
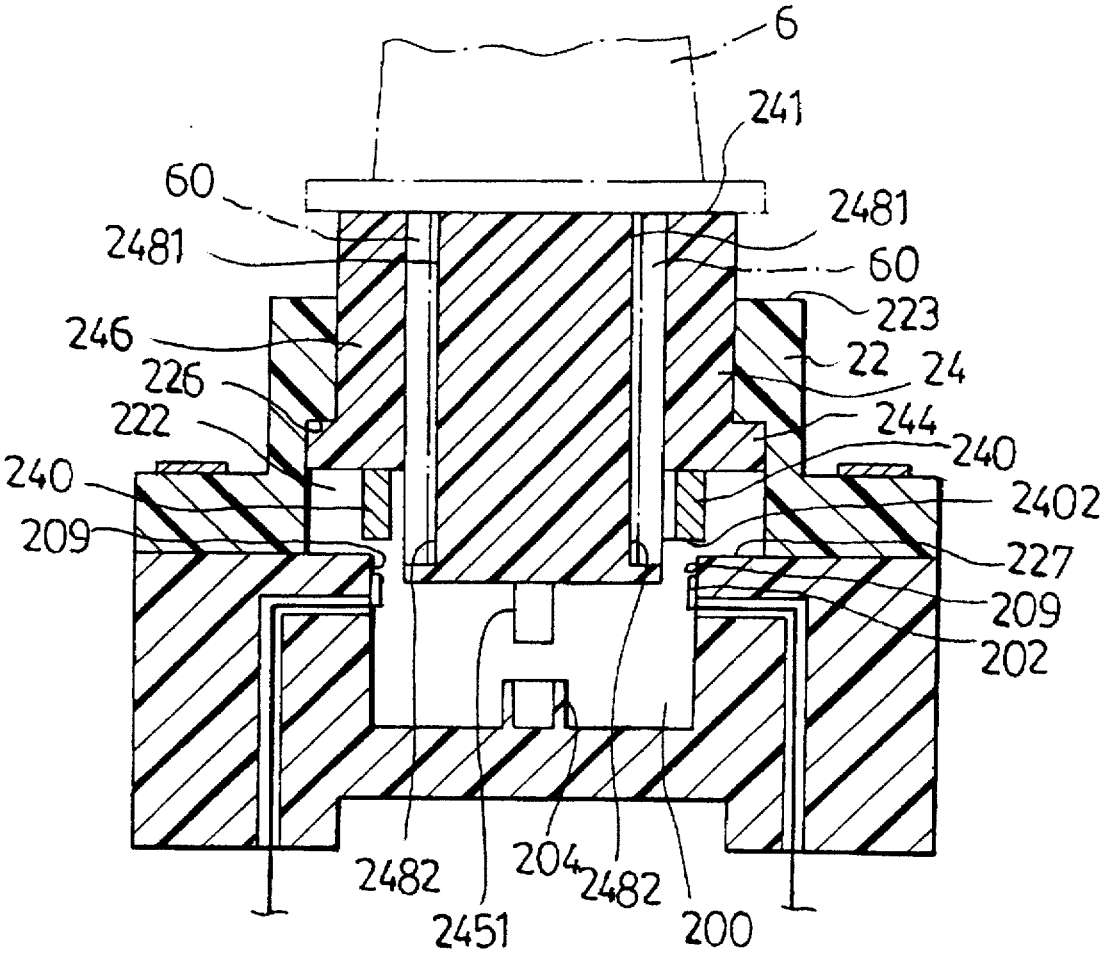
FIG. 8 is a sectional schematic view illustrating the preferred embodiment when in use, wherein the receptacle body is in a first position.

The receptacle body 24 has a cylindrical front portion 246 with first and second ends 241, 242, an annular flange 244 extending radially from the second end 242 of the front portion 246, and a rear portion 245 extending coaxially from the second end 242 of the front portion 246. The rear portion 245 has two opposite wider sides 247, as best illustrated in FIG. 5. The front portion 246 is inserted coaxially and slidably into the first section 221 of the through bore 220 so that the receptacle body 24 can be moved between a first position, wherein the annular flange 244 abuts the first shoulder 226 and the first end 241 of the front portion 246 of the receptacle body 24 extends out of the first face 223 of the front insulative body 22, as best illustrated in FIG. 8, and a second position, where the annular flange 244 abuts the second shoulder 227 and the rear portion 245 of the receptacle body 24 extends into the cavity 200 of the rear insulative body 20, as best illustrated in FIG. 4. The front portion 246 has a pair of socket openings 2481 which extends from the first end 241 to the second end 242 thereof, as best illustrated in FIGS. 3 and 6. Each of the wider sides 247 of the rear portion 245 has an axially extending groove 2482 which is connected to a respective one of the socket openings 2481.

Figure 7:
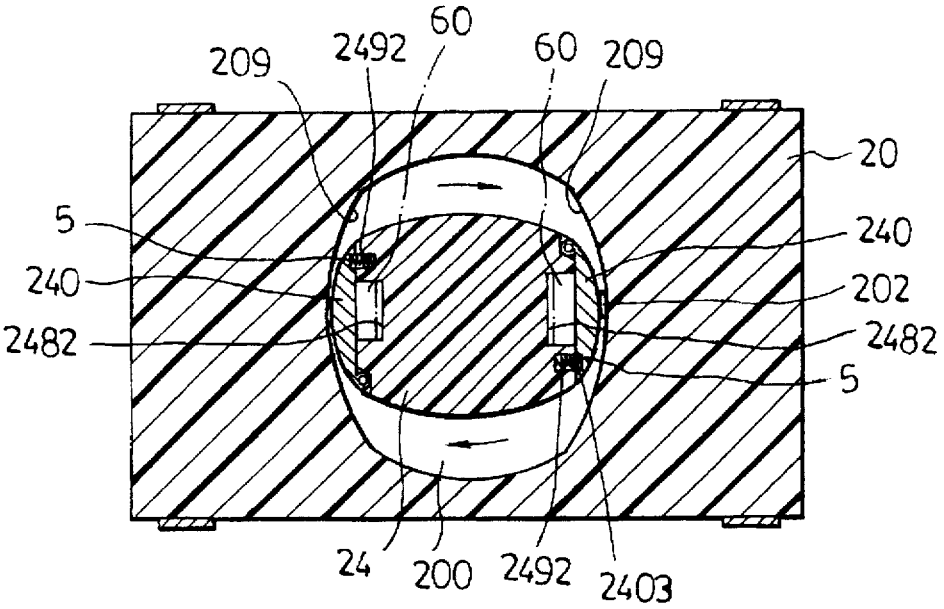
FIG. 7 is a cross sectional view taken along the line VII—VII in FIG. 6.

Referring to FIG. 5, each of the wider sides 247 further has a conductor 240 which is disposed over a respective one of the axially extending grooves 2482 and which has a first end 2401 connected pivotally to one side of the axially extending groove 2482 and a second end 2402 located on the other side of the axially extending groove 2482, and a biasing member 5 which is mounted between the other side of the axially extending groove 2482 and the second end 2402 of the conductor 240 in order to urge the conductor 240 to move away from the axially extending groove 2482. In the preferred embodiment, the first end 2401 of each of the conductors 240 has a pivot axle 4 connected thereto and each of the wider sides 247 has a positioning groove 2491 in which the pivot axle 4 is mounted. The biasing member 5 is a coiled spring which has a first end that engages a bore 2492 in a corresponding one of the wider sides 247 and a second end that engages a bore 2403 in a corresponding one of the conductors 240. Therefore, when a pair of contact blades 60 of an electrical plug 6 are inserted into the socket openings 2481 and extend into the axially extending grooves 2482 and when the receptacle body 24 in the second position is rotated by a predetermined angle, for example 90°, the conductors 240 can be depressed by the contacts 202 of the rear insulative body 20 against the biasing force of the biasing member 5 so as to engage the contact blades 60 which are received in the axially extending grooves 2482, as best illustrated in FIG. 7. The conductors 240 may be moved away from the axially extending grooves 2482 and be disengaged from the contact blades 60 and the contacts 202 when the receptacle body 24 is further rotated by the predetermined angle in a reverse direction.

Referring to FIGS. 4 and 6, the cavity 200 of the rear insulative body 20 has a bottom face 203 and a tube member 204 provided centrally on the bottom face 203 of the cavity 200. The rear portion 245 of the receptacle body 24 has a free end which is formed with a cylindrical central projection 2451. The central projection 2451 is fitted rotatably in the tube member 204 when the receptacle body 24 is in the second position in order to facilitate stable coaxial rotation of the receptacle body 24 with respect to the front insulative body 22.

In use, with reference to FIG. 6, the contact blades 60 of a plug 6, which are shown in phantom lines, are inserted into the socket openings 2481 and extend into the axially extending grooves 2482. In this stage, the conductors 240 are not depressed by the narrower side walls 209 and are urged to move away from the contact blades by the biasing members 5, as shown in FIG. 5. The receptacle body 24 in the second position is then rotated clockwise by 90° to a position where the conductors 240 are depressed by the contacts 202 and interconnect the contacts 202 and the contact blades 60 in the axially extending grooves 2482, as best illustrated in FIG. 7. Thus, contact blades 60 of the plug 6 can be connected to an electrical power source (not shown). When the electrical plug 6 is to be pulled out of the electrical socket 2, the receptacle body 24 is rotated counterclockwise by 90° and returns to the original position, as shown in FIG. 5, in order to disengage the conductors 240 from the contacts 202 and the contact blades 60. Thereby, the plug 6 can be pulled out of the electrical socket 2 when the contact blades 60 is disconnected with the power source.

Alternatively, the electrical plug 6 in the position shown in FIG. 7 may be pulled directly out of the electrical socket without rotating the receptacle body 24 reversely. In this case, because the contact blades 60 frictionally engage the conductors 240 and the narrower side walls 209 when the receptacle body 24 is moved from the second position to the first position, the first end 241 of the front portion 246 of the receptacle body 24 is pulled out of the through bore 220. At this time, the conductors 240 are disengaged from axially extending grooves 2482 and are moved into the second section 222 (See FIG. 4) of the through bore 220. The second ends 2402 of the conductors 240 are then moved away from the wider sides 247 and are disengaged from the contact blades 60 by means of the biasing members 5, as best illustrated in FIG. 8. Therefore, the contact blades 60 can be disconnected from the electric power source and be pulled out of the receptacle body 24.

If the user inserts the electrical plug 6 into the receptacle body 24 in the first position which is shown in FIG. 8 and pushes the receptacle body 24 toward the second position, the second ends 2402 of the conductors 240 will abut against the second shoulder 227, preventing the entry of the rear portion 245 into the cavity 200. To permit the rear portion 245 to move into the cavity 200, the user must rotate the receptacle body counterclockwise by 90°. After the receptacle body 24 is moved to the second position, the user may rotate the receptacle body 24 clockwise by 90° in order to connect the contact blades 60 and the electrical power source in an aforementioned manner.

The advantages of the safety electrical socket of the present invention are as follows:

1. The electrical plug 6 may be inserted into and pulled out of the electrical socket 2 when the contact blades are disengaged from the electrical power source, ensuring that electrical appliances will be plugged and unplugged from the electrical socket 2.

2. The contact blades 60 will not connect to the electrical power source immediately after being inserted into the socket openings 2481 and the axially extending grooves 2482 of the receptacle body 24. Therefore, accidental fire or electrical shock will not occur when a child unknowingly inserts a conductive object into the electrical socket 2.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangement.

I claim:

1. A safety electrical socket, comprising:

a rear insulative body having a generally flat face, a cavity which is formed in said flat face and which has two opposed, narrower side walls, a pair of contacts fixed respectively to said narrower side walls, and two wires connected respectively to said contacts for supplying electrical power to said contacts;

a front insulative body having opposed first and second faces, a through bore extending from said first face to said second face, said second face being generally flat, said through bore being formed of a first section of a smaller diameter which is adjacent to said first face, a second section which is adjacent to said second face, and a first shoulder which is formed between said first and second sections, said front insulative body being detachably connected to said rear insulative body so that said second face abuts said flat face of said rear insulative body and said through bore of said front insulative body is concentric with said cavity of said rear insulative body, said cavity having a size which is smaller than that of said second section of said through bore, thereby defining a second shoulder between said second face of said front insulative body and said flat face of said rear insulative body;

a receptable body having a cylindrical front portion with first and second ends, an annular flange extending radially from said second end of said front portion, and a rear portion extending coaxially from said second end of said front portion, said rear portion having two opposite wider sides, said front portion being inserted coaxially and slidably into said first section of said through bore so that said receptacle body can be moved between a first position, where said annular flange abuts said first shoulder and said first end of said front portion of said receptacle body extends out of said first face of said front insulative body, and a second position, where said annular flange abuts said second shoulder and said rear portion of said receptacle body extends into said cavity of said rear insulative body, said front portion having a pair of socket openings which extends from said first end to said second end thereof, each of said wider sides of said rear portion having an axially extending groove which is connected to a respective one of said socket openings, a conductor which is disposed over said axially extending groove and which has a first end connected pivotally to a first side of said axially extending groove and a second end located on the other side of said axially extending groove, and a biasing member which is mounted between a second side of said axially extending groove and said second end of said conductor in order to urge said conductor to move away from said axially extending groove, so that when a pair of contact blades of an electrical plug are inserted into the socket openings and extend into said axially extending grooves and when said receptacle body in said second position is rotated by a predetermined angle, said conductors can be depressed by said contacts of said rear insulative body against the biasing force of said biasing blades which are received in said axially extending grooves, and so that when said receptacle body is further rotated by the predetermined angle in a reverse direction, said conductors can be moved away from said axially extending grooves and be disengaged from said contact blades and said contacts.

2. A safety electrical socket as claimed in claim 1, wherein said cavity of said rear insulative body has a bottom face and a tube member provided centrally on said bottom face of said cavity, and wherein said rear portion of said receptacle body has a free end which is formed with a cylindrical central projection, said central projection being fitted rotatably in said tube member when said receptacle body is in said second position.

3. A safety electrical socket as claimed in claim 1, wherein said first end of each of said conductors has a pivot axle connected thereto, and each of said wider sides having a positioning groove in which said pivot axle is mounted.

4. A safety electrical socket as claimed in claim 1, wherein each of said biasing members is a coiled spring which has a first end that is connected to a corresponding one of said wider sides and a second end that is connected to a corresponding one of said conductors.

* * * * *